US006200669B1

(12) United States Patent
Marmon et al.

(10) Patent No.: US 6,200,669 B1
(45) Date of Patent: Mar. 13, 2001

(54) ENTANGLED NONWOVEN FABRICS AND METHODS FOR FORMING THE SAME

(75) Inventors: Samuel Edward Marmon, Alpharetta; Elisha Seidah Wazeerud-Din, Decatur, both of GA (US); Brett Peter Samuels, Winston-Salem, NC (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 08/756,426

(22) Filed: Nov. 26, 1996

(51) Int. Cl.[7] ..... D04H 3/12; D04H 3/14

(52) U.S. Cl. ..... 428/198; 442/344; 442/350; 442/359; 442/362; 442/408; 442/411

(58) Field of Search ..... 28/104, 167; 156/62.6, 156/73.1, 291, 308.2; 428/198; 442/344, 350, 359, 362, 408, 411

(56) References Cited

U.S. PATENT DOCUMENTS

| | | | | |
|---|---|---|---|---|
| 3,692,618 | | 9/1972 | Dorschner et al. . | |
| 3,924,045 | | 12/1975 | Ogasawara et al. | 428/373 |
| 3,966,865 | | 6/1976 | Nishida et al. | 264/147 |
| 4,073,988 | | 2/1978 | Nishida et al. | 428/91 |
| 4,239,720 | | 12/1980 | Gerlach et al. | 264/147 |
| 4,369,156 | | 1/1983 | Mathes et al. | 264/147 |
| 4,381,335 | | 4/1983 | Okamoto | 428/373 |
| 4,442,161 | | 4/1984 | Kirayoglu et al. | 428/219 |
| 4,460,649 | | 7/1984 | Park et al. | 428/373 |
| 4,663,221 | | 5/1987 | Makimura et al. | 428/224 |
| 4,856,152 | | 8/1989 | Kis | 28/114 |
| 4,939,016 | | 7/1990 | Radwanski et al. | 428/152 |
| 4,950,531 | | 8/1990 | Radwanski et al. | 428/284 |
| 5,009,747 | | 4/1991 | Viazmensky et al. | 162/115 |
| 5,162,074 | | 11/1992 | Hills | 156/644 |
| 5,188,895 | | 2/1993 | Nishino et al. | 428/373 |
| 5,284,703 | | 2/1994 | Everhart et al. | 428/283 |
| 5,292,581 | | 3/1994 | Viazmensky et al. | 428/288 |
| 5,355,565 | | 10/1994 | Baravian | 28/104 |
| 5,405,698 | | 4/1995 | Dugan | 428/373 |
| 5,466,410 | | 11/1995 | Hills | 264/172.11 |
| 5,466,516 | | 11/1995 | Lutzow et al. | 428/282 |
| 5,534,339 | * | 7/1996 | Stokes | 442/362 |
| 5,662,978 | * | 9/1997 | Brown et al. | 442/362 |
| 5,718,972 | | 2/1998 | Murase et al. | 428/360 |
| 5,783,503 | | 7/1998 | Gillespie et al. | 442/340 |
| 5,795,651 | | 8/1998 | Matsouka et al. | 428/364 |

FOREIGN PATENT DOCUMENTS

| | | | |
|---|---|---|---|
| 2129173 | 1/1996 | (CA) | D04H/1/56 |
| 0694644 B1 | 2/1994 | (EP) . | |
| 0 413 688 B1 | 6/1994 | (EP) | D01D/4/00 |
| 0694644B1 | 7/1994 | (EP) . | |
| 50100312 | 8/1975 | (JP) | D01F/8/06 |
| 52088622 | 7/1977 | (JP) | D01F/8/12 |
| 59-100750 | 6/1984 | (JP) | D04H/1/42 |
| 63-145462 | 6/1988 | (JP) | D04H/1/46 |
| 2169720 | 6/1990 | (JP) | D01F/8/06 |
| 2169723 | 6/1990 | (JP) | D01D/5/30 |
| 02 182962 | 7/1990 | (JP) . | |
| 4173144 | 6/1992 | (JP) | B41F/35/06 |
| 4289222 | 10/1992 | (JP) | D01D/5/36 |
| 6070954 | 3/1994 | (JP) | A61F/5/44 |
| 97 21862 | 6/1997 | (WO) . | |
| 98/03710 | 1/1998 | (WO) . | |
| 98/09010 | 3/1998 | (WO) . | |

OTHER PUBLICATIONS

Japanese Derwent Abstract 6073613A, Mar. 15, 1994.
Abstract of JP 07 238450, published Sep. 12, 1995.
Abstract of JP 06 306754, published Nov. 1, 1994.
Abstract of JP 05 214653, published Aug. 24, 1993.
Abstract of JP 06 166936, published Jun. 14, 1994.

* cited by examiner

*Primary Examiner*—Elizabeth M. Cole
*Assistant Examiner*—Christopher C. Pratt
(74) *Attorney, Agent, or Firm*—Douglas H. Tulley, Jr.

(57) ABSTRACT

Nonwoven webs are fabricated by forming unitary multicomponent fibers comprising a plurality of individual segments partially exposed at the surface of the fiber; bonding the multicomponent fibers, such as by thermal point bonding, and then hydroentangling the bonded multicomponent fibers with a water pressure from about 400 to 3000 psi wherein the entangling process separates the individual segments of the unitary multicomponent fibers into microfibers and also entangles the fibers to form an integrated nonwoven web. The nonwoven webs include entangled webs of thermoplastic multicomponent fibers and microfibers having partially degraded bond areas comprising from about 5% to about 50% at the surface area of the web.

13 Claims, 16 Drawing Sheets

ENTANGLED NONWOVEN FABRICS AND METHODS FOR FORMING THE SAME

FIELD OF THE INVENTION

The present invention relates to nonwoven fabrics. More particularly, the present invention relates to nonwoven webs and methods for forming the same from splittable multicomponent fibers.

BACKGROUND OF THE INVENTION

Multicomponent fibers and methods of fibrillating multicomponent fibers to create fine fibers are known in the art. Multicomponent fibers, also referred to as "conjugate fibers" or "fibrillatable fibers", contain at least two components that occupy distinct cross-sections along substantially the entire length of the fiber. They are typically produced by simultaneously and continuously extruding a plurality of molten fiber forming polymers through spinning orifices of a spinneret to form unitary filament strands. The composition of the individual components, which collectively comprise the multicomponent fibers, are often selected from dissimilar polymers which are not miscible in one another and which further have different coefficients of contraction, different solubility characteristics and/or other distinct physical properties. In this regard the selection of the polymers for the individual components or segments is often limited by the properties required for separation of adjacent segments.

One method which has been used to fibrillate unitary multicomponent fibers is to cause disparative swelling and shrinkage of one of the components relative to the others. This causes separation of the multicomponent fibers into two or more of its individual components. For example, U.S. Pat. No. 3,966,865 issued to Nishida et al. discloses a method of forming synthetic fibrous structures from multicomponent fibers in which the individual components may comprise a polyamide and either a polyester, polyolefin or polyacrylonitrile. The polyamide component is swelled and shrunk by treatment with an aqueous solution of an alcohol, such as benzyl alcohol or phenylethyl alcohol, causing separation. Similarly, U.S. Pat. No. 4,369,156 issued to Mathes et al. discloses a process for separating a multicomponent fiber of a copolyamide and a polyester by treatment with liquid or vaporous water 10–20° C. below the softening point of the copolyamide. This treatment causes disparative shrinkage of the polymers and, thus, separation. However, separation by such processes may result in low and/or uneven fibrillation as well as fibers or fabrics which have lost desired characteristics, e.g. softness and bulk. In addition, such processes often require complex and lengthy processing which may also generate by-products which are costly to dispose.

Another method employed in separating the individual components of a multicomponent fiber is coextruding incompatible fiber-forming polymers into a unitary fiber and then dissolving one of the polymers thereby freeing the insoluble components. For example, U.S. Pat. No. 5,405,698 to Dugan teaches a multicomponent fiber composed of a plurality of water-insoluble polyolefin filaments surrounded by a water-soluble polymer. Such a configuration is often referred to as an "islands-in-sea" type fiber. The multicomponent fiber is treated with water thereby dissolving the water-soluble polymer and releasing the individual water-insoluble polyolefin filaments. Similarly, U.S. Pat. No. 4,460,649 issued to Park et al. teaches a multicomponent fiber composed of a polyamide and a polyester having wedged shaped segments surrounded by an outer component which is part of a central core. The outer component may be removed by a chemical process, such as treatment with an acid or alkali, and the remaining components separated by a swelling agent. However, separation in accord with such processes often utilizes polymers and/or solvents which are uneconomical and which generate considerable by-products which are environmentally undesirable and costly to dispose. Furthermore, such processes may result in fibers which have lost desired characteristics, i.e. softness, due to the chemical treatments. It is also important to note that such process inherently cause a considerable loss in bulk due to the removal of a substantial portion of the polymeric material forming the initial multicomponent fibers.

Thus, there exists a need for a method of producing a nonwoven web from splittable multicomponent fibers and a method for fibrillating the multicomponent fibers which does not destroy or degrade the desired characteristics of the polymeric fibers and/or the web resulting therefrom. There further exists a need for such a process which allows a wider variety of compatible polymers for use in splittable multicomponent fibers. Additionally, there exists a need for nonwoven webs and articles made therefrom having durable microfibers, a soft cloth-like feel, good bulk, high coverage (opacity), good barrier properties and improved hydroentangling processing characteristics.

SUMMARY OF THE INVENTION

The aforesaid needs are fulfilled and the problems experienced by those skilled in the art overcome by the present invention which provides a method of fabricating a nonwoven web comprising the steps of (a) forming a substrate of multicomponent fibers wherein the multicomponent fibers are comprised of at least two components wherein each component is partially exposed on the outer surface of the multicomponent fiber; (b) bonding the multicomponent fibers of said substrate; and thereafter (c) entangling the bonded substrate of multicomponent fibers, wherein the individual components become separated from the multicomponent fibers and further wherein the multicomponent fibers and components separated therefrom become entangled to form an integrated nonwoven web. In a further aspect, the bonding may comprise thermal or ultrasonic bonding at least about 5% of the surface area of the multicomponent fiber substrate, desirably from about 5 to about 50% of the surface area of the substrate. Entangling of the bonded multicomponent fiber substrate may be accomplished by hydroentangling the fibers; optionally by subjecting the multicomponent fibers to a plurality of entangling treatments, such as hydroentangling each side of the bonded multicomponent fiber substrate. The individual segments or components of the multicomponent fibers occupy distinct cross-sections or "zones" and, in one aspect, may comprise a plurality of pie shaped regions. In a further aspect, the individual components may comprise melt-spinnable materials which have a low mutual affinity and which are not miscible in each other, such as a polyolefin and a non-polyolefin, although materials which tend to readily adhere to one another may likewise be used with the addition of a suitable lubricant or slip agent.

A further aspect of the invention provides a nonwoven web comprising an entangled web of continuous multicomponent thermoplastic fibers, wherein at least a portion of said multicomponent fibers are separated into the individual components. The entangled web may have bond areas therein comprising at least about 5% of the surface area of the web. The bond areas are at least partially degraded with a portion of the continuous fibers within the bond areas separated from said bond points. The nonwoven web desirably has bond areas comprising from about 5 to about 50% of the surface area of the web and, even more desirably, from about 10 to about 30% of the surface area of the web. In addition, the nonwoven web may have bond areas which are discrete areas spaced across substantially the entire surface area of the web.

BRIEF DESCRIPTION OF THE DRAWINGS

FIGS. 8A–10A and 8B–10B are SEMs (100× magnification) of a representative unbonded and bonded area, respectively, of a nonwoven web formed by bonding the fabric prior to hydroentangling.

DEFINITIONS

Figure 1:
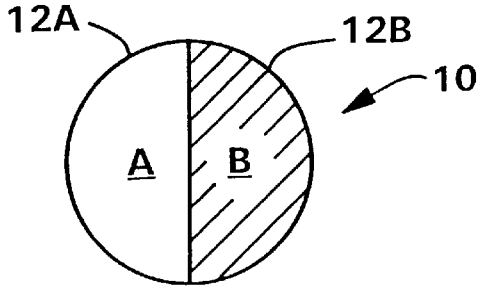
FIGS. 1–5 are cross-sectional views of exemplary multicomponent fibers suitable for use with the present invention.

As used herein the term "nonwoven fabric" or "nonwoven web" means a web having a structure of individual fibers or threads which are interlaid, but not in an identifiable manner as in a knitted fabric. The basis weight of nonwoven fabrics is usually expressed in ounces of material per square yard (osy) or grams per square meter (gsm).

The term "fiber" as used herein refers to an elongated extrudate formed by passing a polymer through a forming orifice such as a die. Unless noted as otherwise the term "fibers" include discontinuous strands having a definite length and continuous strands of material, such as filaments. The nonwoven fabric of the present invention may be formed from staple multicomponent fibers. Such staple fibers may be carded and bonded to form the nonwoven fabric. Desirably, however, the nonwoven fabric of the present invention is made with continuous multicomponent filaments which are extruded, drawn, and laid on a traveling forming surface.

As used herein the term "microfibers" means small diameter fibers having an average diameter not greater than about 12 microns, for example, having an average diameter of from about 3 microns to about 8 microns. Fibers are also commonly discussed in terms of denier. A lower denier indicates a finer fiber and a higher denier indicates a thicker or heavier fiber. For example, a 15 micron polypropylene fiber has a denier of about 1.42 ($15^2 \times 0.89 \times 0.00707 = 1.415$).

As used herein the term "multicomponent fibers" or "conjugate fibers" refers to fibers which have been formed from at least two polymer components. Such fibers are usually extruded from separate extruders but spun together to form one fiber. The polymers of the respective components are usually different from each other although multicomponent fibers may comprise separate components of similar or identical polymeric materials. The individual components are typically arranged in substantially constantly positioned distinct zones across the cross-section of the fiber and extend substantially along the entire length of the fiber. The configuration of such fibers may be, for example, a side by side arrangement, a pie arrangement or other arrangement. Bicomponent fibers and methods of making the same are taught in U.S. Pat. No. 5,108,820 to Kaneko et al., U.S. Pat. No. 4,795,668 to Krueger et al., U.S. Pat. No. 5,382,400 to Pike et al., U.S. Pat. No. 5,336,552 to Strack et al. and U.S. patent application Ser. No. 08/550,042 filed Oct. 30, 1996 to Cook. The fibers and individual components comprising the same may also have various irregular shapes such as those described in U.S. Pat. No. 5,277,976 to Hogle et al., U.S. Pat. Nos. 5,162,074 and 5,466,410 to Hills, and U.S. Pat. Nos. 5,069,970 and 5,057,368 to Largman et al. The entire contents of the aforesaid patents and application are incorporated herein by reference.

As used herein, the term "hot air knife" or HAK means a process of bonding a just produced web, particularly spunbond, in order to give it sufficient integrity, i.e. increase the strength of the web, for further processing. A hot air knife is a device which focuses a stream of heated air at a very high flow rate, generally from about 1000 to about 10000 feet per minute (fpm) (305 to 3050 meters per minute), or more particularly from about 3000 to 5000 feet per minute (915 to 1525 m/min.) directed at the nonwoven web after its formation. The air temperature is usually in the range of the melting point of at least one of the polymers used in the web, generally between about 200 and 550° F. (93 and 290° C.) for the thermoplastic polymers commonly used in spunbonding. The control of air temperature, velocity, pressure, volume and other factors helps avoid damage to the web while increasing its integrity. The HAK process has a great range of variability and controllability of many factors such as air temperature, velocity, pressure, volume, slot or hole arrangement and size, and the distance from the HAK plenum to the web. The HAK is further described in commonly assigned U.S. patent application Ser. No. 08/362,328 to Arnold et al., filed Dec. 22, 1994 and commonly assigned; the contents of which are incorporated herein by reference.

As used herein, through-air bonding or "TAB" means a process of bonding a nonwoven bicomponent fiber web in which air which is sufficiently hot to melt one of the polymers of which the fibers of the web are made is forced through the web. The air velocity is between 100 and 500 feet per minute and the dwell time may be as long as 6 seconds. The melting and resolidification of the polymer provides the bonding. Through air bonding has relatively restricted variability and since through-air bonding TAB requires the melting of at least one component to accomplish bonding and is therefore particularly useful in connection with webs with two components like conjugate fibers or those which include an adhesive. In the through-air bonder, air having a temperature above the melting temperature of one component and below the melting temperature of another component is directed from a surrounding hood, through the web, and into a perforated roller supporting the web. Alternatively, the through-air bonder may be a flat arrangement wherein the air is directed vertically downward onto the web. The operating conditions of the two configurations are similar, the primary difference being the geometry of the web during bonding. The hot air melts the lower melting polymer component and thereby forms bonds between the filaments to integrate the web.

As used herein, "ultrasonic bonding" means a process performed, for example, by passing the fabric between a sonic horn and anvil roll as illustrated in U.S. Pat. No. 4,374,888 to Bornslaeger.

As used herein "thermal point bonding" involves passing a fabric or web of fibers to be bonded between one or more heated rolls, such as a heated calender roll and an anvil roll. The calender roll is usually patterned in some way so that the fabric is not bonded across its entire surface, and the anvil roll is usually flat. As a result, various patterns for calender rolls have been developed for functional as well as aesthetic reasons. One example is the Hansen and Pennings or "H&P" pattern with about a 30% bond area when new with about 200 bonds/square inch as taught in U.S. Pat. No. 3,855,046 to Hansen and Pennings, the entire contents of which are incorporated herein by reference. The H&P pattern has square point or pin bonding areas wherein each pin has a side dimension of 0.038 inches (0.965 mm), a spacing of 0.070 inches (1.778 mm) between pins, and a depth of bonding of 0.023 inches (0.584 mm). The resulting pattern has a bonded area of about 29.5% when new. Another typical point bonding pattern is the expanded Hansen & Pennings or "EHP" bond pattern which produces a 15% bond area when new with a square pin having a side dimension of 0.037 inches (0.94 mm), a pin spacing of 0.097 inches (2.464 mm) and a depth of 0.039 inches (0.991 mm). Another typical point bonding pattern designated "714" has square pin bonding areas wherein each pin has a side dimension of 0.023 inches, a spacing of 0.062 inches (1.575 mm) between pins, and a depth of bonding of 0.033 inches (0.838 mm). The resulting pattern has a bonded area of about 15% when new. Yet another common pattern is the C-Star pattern which has a bond area of about 16.9% when new. The C-Star pattern has a cross-directional bar or "corduroy" design interrupted by shooting stars. Other common patterns include a diamond pattern with repeating and slightly offset diamonds with about a 16% bond area when new and a wire weave pattern looking similar to a window screen, with about a 19% bond area when new.

As used herein, the term "polymer" generally includes, but is not limited to, homopolymers, copolymers, such as for example, block, graft, random and alternating copolymers, terpolymers, etc., and blends and modifications thereof. Furthermore, unless otherwise specifically limited, the term "polymer" shall include all possible geometric configurations of the molecules. These configurations include, but are not limited to, isotactic, syndiotactic and random symmetries.

As used herein, the term "machine direction" or MD means the length of a fabric in the direction in which it is produced. The term "cross machine direction" or CD means the width of fabric, i.e. a direction generally perpendicular to the MD.

As used herein, the term "garment" means any type of non-medically oriented apparel which may be worn. This includes industrial work wear and coveralls, undergarments, pants, shirts, jackets, gloves, socks, and the like.

As used herein, the term "infection control product" means medically oriented items such as surgical gowns and drapes, face masks, head coverings like bouffant caps, surgical caps and hoods, footwear like shoe coverings, boot covers and slippers, wound dressings, bandages, sterilization wraps, wipers, garments like lab coats, coveralls, aprons and jackets, patient bedding, stretcher and bassinet sheets, industrial coveralls, and the like.

As used herein, the term "personal care product" means diapers, training pants, absorbent underpants, adult incontinence products, and feminine hygiene products.

DESCRIPTION OF THE INVENTION

The process of the present invention may, generally speaking, include the steps of forming multicomponent fibers and bonding the fiber layer in order to form a bonded substrate of multicomponent fibers. The bonded substrate of multicomponent fibers may then be entangled creating a highly integrated nonwoven web with significant separation of individual components from the unitary multicomponent fibers.

Figure 2:
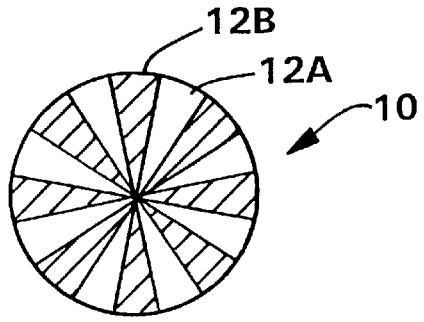

In fabricating a multicomponent fiber most useful with the present invention, the individual segments or components that collectively comprise the unitary multicomponent fiber are contiguous along the longitudinal direction of the multicomponent fiber in a manner such that a plurality of components or segments form part of the outer surface of the unitary multicomponent fiber. In other words, a plurality of segments or components are exposed along a portion of the outer perimeter of the multicomponent fiber. For example, in reference to FIG. 1, a unitary multicomponent fiber 10 is shown, having a side-by-side configuration, with a first segment or component 12A forming part of the outer surface of the multicomponent fiber 10 and a second segment or component 12B forming the remainder of the outer surface of the multicomponent fiber 10. A particularly useful configuration, as shown in FIG. 2, is a plurality of radially extending wedge-like shapes, which in reference to the cross-section of the segments, are thicker at the outer surface of the multicomponent fiber 10 than at the inner portion of the multicomponent fiber 10. In one aspect, the multicomponent fiber 10 may have an alternating series of individual wedge-shaped segments or components 12A and 12B of different polymeric materials.

Figure 3:
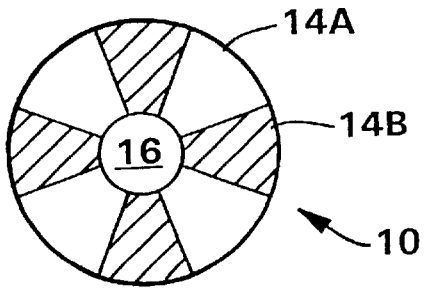
Figure 4:
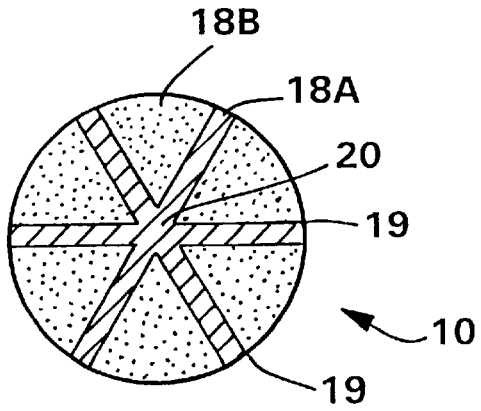
Figure 5:
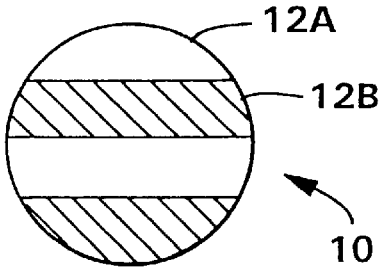

In addition to circular fiber configurations, the multicomponent fibers may comprise other shapes, such as square, multilobal, ribbon and/or other shapes. Additionally, in reference to FIG. 3, multicomponent fibers may be employed, having alternating segments 14A and 14B about a hollow center 16. In a further aspect, as shown in FIG. 4, a multicomponent fiber 10 suitable for use with the present invention may comprise individual components 18A and 18B wherein a first segment 18A comprises a single filament with radially extending arms 19 that separate a plurality of additional segments 18B. Although separation should occur between the components 18A and 18B it may often not occur between the lobes or arms 19 due to the central core 20 connecting the individual arms 19. Thus, in order to achieve more uniform fibers it may often be desirable that the individual segments or components do not have a cohesive central core. In a further aspect and in reference to FIG. 5, alternating segments 12A and 12B forming the multicomponent fiber 10 may extend across the entire cross-section of the fiber. As discussed herein below, it will also be appreciated that the plurality of individual segments may comprise identical or similar materials as well as two or more different materials.

Figure 6:
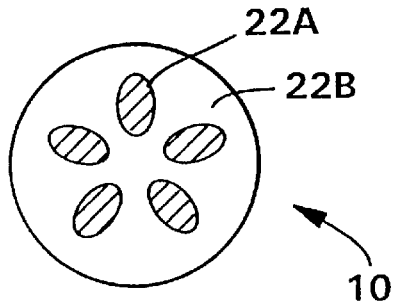
FIG. 6 is a cross-sectional view of a multicomponent fiber having poorly defined individual segments which are not exposed on the outer surface of the multicomponent fiber.

The individual segments, although of varied shape, preferably have distinct boundaries or zones across the cross-section of the fiber. Forming a hollow fiber type multicomponent fiber may be preferred with some materials in order to prevent segments of like material from bonding or fusing at contact points in the inner portion of the multicomponent fiber. Further, as mentioned above, it is also preferred that the shapes are well defined or "distinct" in the that they do not overlap adjacent segments along the outer surface of the multicomponent fiber. For example, as shown in FIG. 6, alternating segments 22A and 22B are shown wherein portions of segments 22B "wrap around" the outer portion of the adjacent segments 22A. This overlap will often impede and/or prevent separation of the individual segments, particularly where segment 22A is fully engulfed by adjacent segments 22B. Thus, "wrap around" is therefore preferably avoided and the formation of well defined or distinct shapes highly desirable.

In fabricating well defined segment shapes it has been found that matching the viscosities of the respective thermoplastic materials helps prevent the "wrap-around" discussed above. This may be accomplished by several different means. For example, the temperatures of the respective materials may be run at opposed ends of their melt ranges or processing window; e.g. when forming a pie shaped multicomponent fiber form nylon and polyethylene, the polyethylene may be heated to a temperature near the lower limit of its melt range, about 390° C. and the nylon heated to a temperature near the upper limit of its melt range, about 500° C. In this regard, one of the components could be brought into the spin-pack at a temperature below that of the spin pack such that it is processed at a temperature near the lower end of its processing window whereas the other material may be introduced at a temperature to ensure processing at the upper end of its processing window. In addition, it is known in the art that certain additives may be employed to either reduce or increase the viscosity of the polymeric materials as desired.

One skilled in the art will appreciate that fibrillating a multicomponent fiber having a small diameter, e.g. 15 microns, and which comprises numerous individual segments will result in a web having numerous fine fibers. One skilled in the art will appreciate that this aspect of the invention allows for the creation of a web incorporating spunbond microfibers which is of particular interest since, unlike meltblown fibers, spunbond fibers typically cannot be spun smaller than about 12 to 15 microns in diameter. It is also important to note that the process of the present invention allows for the use of multicomponent fibers where the size of the individual segments and their respective polymeric materials may be disproportionate to one another. The individual segments may be varied as much as 95:5 by volume although ratios of 80:20 or 75:25 may be more easily fabricated. For example, in reference to FIG. 3, individual segments 14A and 14B have a disproportionate size with respect to each other. The ability to achieve good separation when using such varied proportions is often important in achieving a low cost web. In this regard if one of the polymers comprising the segments is significantly more expensive than the polymers comprising the remaining segments, the amount of the expensive polymeric material may be reduced by decreasing the size of its respective segments.

A wide variety of polymeric materials are known to be suitable for use in fabricating multicomponent fibers and the use of all such materials are believed suitable for use in the present invention. Examples include, but are not limited to, polyolefins, polyesters, polyamides, as well as other melt-spinnable and/or fiber forming polymers. The polyamide which may be used in the practice of this invention may be any polyamide known to those skilled in the art including copolymers and mixtures thereof. Examples of polyamides and their methods of synthesis may be found in "Polymer Resins" by Don E. Floyd (Library of Congress Catalog number 66-20811, Reinhold Publishing, NY, 1966). Particularly commercially useful polyamides are nylon-6, nylon 66, nylon-11 and nylon-12. These polyamides are available from a number of sources such as Emser Industries of Sumter, S.C. (Grilon® & Grilamid® nylons) and Atochem Inc. Polymers Division, of Glen Rock, N.J. (Rilsan® nylons), among others. Many polyolefins are available for fiber production, for example polyethylenes such as Dow Chemical's ASPUN® 6811A LLDPE (linear low density polyethylene), 2553 LLDPE and 25355 and 12350 high density polyethylene are such suitable polymers. Fiber forming polypropylenes include Exxon Chemical Company's Escorene® PD 3445 polypropylene and Himont Chemical Co.'s PF-304. Numerous other suitable fiber forming polyolefins, in addition to those listed above, are also commercially available.

Although numerous materials are suitable for use in melt-spinning or other multicomponent fiber fabrication processes, since the multicomponent fibers may contain two or more different materials one skilled in the art will appreciate that specific materials may not be suitable for use with all other materials. Thus, the composition of the materials comprising the individual segments of the multicomponent fibers should be selected, in one aspect, with a view towards the compatibility of the materials with those of adjacent segments. In this regard, the materials comprising the individual segments should not be miscible with the materials comprising adjacent segments and desirably have a poor mutual affinity for the same. Selecting polymeric materials that tend to significantly adhere to one another under the processing conditions may increase the impact energy required to separate the segments and may also decrease the degree of separation achieved between the individual segments of the unitary multicomponent fibers. It is, therefore, desirable that adjacent segments comprise dissimilar materials. For example, adjacent segments may generally comprise a polyolefin and a non-polyolefin; preferred combinations including alternating components of the following materials: nylon-6 and polyethylene; nylon-6 and polypropylene; polyester and HDPE (high density polyethylene). Other combinations believed suitable for use in the present invention include: nylon-6 and polyester; polypropylene and HDPE. However, it will be appreciated by those skilled in the art that some combinations of polyolefins and non-polyolefins may not process well after being spun such as, for example, where multicomponent fibers adhere to one another forming "ropes". Examples of combinations of materials which may experience such processing problems include: polyester and polypropylene; polyester with LLDPE (linear low density polyethylene).

The use of polymeric materials having a higher degree of mutual affinity may be useful with the present invention by addition of a lubricant or "slip-agent" to one or more of the polymeric materials. The slip-agent added to the polymer formulation prevents the respective materials from adhering to one another during fabrication of the unitary multicomponent fiber. Examples of such lubricants include, but are not limited to, including within the polymer formulations about 0.5 to about 4.0 by weight % SF-19, a silicone polyether, made by PPG Industries, Inc. of Pittsburgh, Pa. or about 250–1000 ppm DYNAMAR FX-5920 which is a fluorocarbon surfactant available from 3M of St. Paul, Minn. Other surfactants and lubricants intended for use with splittable fibers are known in the art and are believed suitable for use with the present invention. In addition, the present invention may be used in connection with other splitting techniques such as, for example, that described in U.S. patent application Ser. No. 08/484,365, filed Jun. 7, 1995, which splits conjugate fibers using a hot aqueous media, the entire contents of which are incorporated herein by reference.

Multicomponent fibers have heretofore been incorporated into knitted and woven synthetic fabrics. However, incorporation of splittable multicomponent fibers, particularly continuous fibers, into a integrated nonwoven web poses considerably greater difficulties. Hydroentangling of multicomponent fibers often results in poor separation of the unitary multicomponent fiber into its individual segments resulting in a web with high air permeability and less barrier-like properties. In addition, when splitting multicomponent fibers by hydroentangling, portions of the resulting web may often become entangled with the screen of the hydroentangling apparatus. Such problems may cause damage to the web and/or slow production of the same by hindering the removal of the nonwoven web from the apparatus. In this regard it has been discovered that by bonding the continuous unitary multicomponent fibers prior to entangling, the resulting nonwoven web has a higher degree of fiber separation and, therefore, improved tactile and physical characteristics. Moreover, the added integrity imparted to the web by bonding significantly reduces and/or eliminates problems associated with the multicomponent fibers becoming entwined on the hydroentangling apparatus.

Numerous methods of bonding thermoplastic fibers are well known in the art; examples include thermal point bonding, HAK, TAB, ultrasonic welding, laser beams, high energy electron beams and/or adhesives. In a preferred embodiment, bonding between the multicomponent fibers may be formed by passing the multicomponent fibers between patterned heated rolls to create thermal point bonding. An exemplary bond pattern is the H&P bond pattern which has a pin density such that when the pins contact a smooth anvil roller they create a bonding area of about 25–30% of the web's surface area. Thermal point bonding may be conducted in accord with the aforesaid Hansen and Pennings patent. However, any one of the numerous other bonding patterns described herein may be utilized with the present invention although it is desirable that the patterned roller create a tight pattern of bond points equally distributed across the entire surface area of the multicomponent fiber substrate. In a further aspect, it is desirable that bonded portions cover at least about 5% of the surface area of the substrate, more desirably from about 5 to about 50% of the surface area, and still more desirably from about 10 to about 30% of the surface area.

Although thermal spot bonding is preferred, the present invention contemplates other forms of bonding which produce adhesion between the unitary multicomponent fibers. As will be appreciated by those skilled in the art the desired bonding patterns may alternatively be induced by ultrasonic welding, laser beams, high energy electron beams and other methods known in the art for forming interfiber bonds between polymeric fibers. In this regard it is believed that an adhesive or bonding agent may be applied to the multicomponent fibers by, for example, spraying or printing, and activated to provide the desired bonding such as at fiber cross-over points. Desirably the adhesive or bonding agent is applied in a tight pattern across substantially the entire web surface. For example, similar to patterns described herein above. Numerous adhesives and methods of applying the same to nonwoven webs are well known in the art.

Methods of entangling fibers to create a nonwoven web are well known in the art, examples include hydraulic entangling or mechanical needling. Generally, hydroentangling creates fibrous nonwoven webs using fine, high pressure, columnar jets which rearrange and intertwine the fibers thereby providing strength and integrity to the web. Hydroentangling is similar to mechanical needling except that penetration of the water jets, as opposed to needles, is utilized to accomplish entanglement of the fibers. The hydraulic entangling may be accomplished utilizing conventional hydraulic entangling processes and equipment such as may be found in U.S. Pat. No. 3,485,706 to Evans, the entire contents of which is incorporated herein by reference. Hydraulic entangling techniques are also disclosed in an article by Honeycomb Systems, Inc., Biddeford, Me., entitled "Rotary Hydraulic Entanglement of Nonwovens," reprinted from INSIGHT 86 INTERNATIONAL ADVANCED FORMING/BONDING CONFERENCE, the entire contents of which are likewise incorporated herein by reference.

Hydroentangling of the present invention may be carried out with any appropriate working fluid such as, for example, water. The working fluid flows through a manifold which evenly distributes the fluid to a series of individual holes or orifices. These holes or orifices may be, for example, from about 0.003 to about 0.015 inch in diameter and may be arranged in one or more rows with any number of orifices, e.g. 40–100 per inch, in each row. Many other manifold configurations may be used, for example, a single manifold may be used or several manifolds may be arranged in succession. The bonded multicomponent substrate may be supported on an apertured support, while treated by streams of liquid from jet devices. The support can be a mesh screen or forming wires. The support can also have a pattern so as to from a nonwoven material with such a pattern therein. Fiber entanglement may be accomplished by jetting fine, essentially columnar, liquid streams toward the surface of the supported bonded substrate. The supported bonded substrate is traversed with the streams until the fibers are randomly entangled and intertwined.

The impact of the pressurized streams of water also causes the individual segments or components forming the unitary multicomponent fiber to separate. The bonded substrate may be passed through the hydraulic entangling apparatus a number of times on one or both sides. Hydroentangling is desirably performed using an energy impact product of from about 0.002 to about 0.15 and, more desirably, from about 0.002 to about 0.1 or from about 0.005 to about 0.05. Energy and impact force may be calculated using the following:

$$E=0.125(YPG/sb)$$

and $$I=PA$$

where

Y is the number of orifices per linear inch;

P is the pressure of the liquid in the manifold in p.s.i.g.;

G is the volumetric flow in cubic feet/minute/orifice;

s is the speed of passage of the web under the streams in feet/minute; and b is the weight of fabric produced in osy (ounces per square yard); and A is the cross-sectional area of the jets in square inches.

Energy Impact Product is E×I which is in HP-hr-lb-force/IbM (horsepower-hour-pound-force/pound-mass). Desirably, generating the hydroentangled webs of the present invention will involve employing water pressures from about 400 to 3000 psi, more desirably from about 700 to 1500 psi.

Subjecting the bonded multicomponent fibers to the entangling process causes separation of unitary multicomponent fibers. In addition, the entangling process also partially degrades the bonding areas within the bonded multicomponent fiber substrate. As indicated above the number, placement and pressure of the jets in the entangling process are desirably configured to impart an energy impact product of at least about 0.002 since lower impact energies often do not generate the desired degree of separation. However, the use of the lowest practicable energy impact product, in particular lower water pressure, is desirous since this requires considerable less energy and recycling of fluid, thereby lowering production costs. In this regard, the process of the present invention often allows for greater fiber separation at lower energy impact products and/or water pressures relative to similar unbonded webs. In addition, the ability to achieve good separation at lower impact energies may translate into the ability to use higher production speeds at the same water pressure. Although the pressure required to separate particular multicomponent fibers will depend on numerous factors, it is noted that substantial separation at lower water pressures may be achieved by the formation of higher quality cross-sectional shaped segments and/or by utilizing polymeric materials in adjacent segments that do not readily adhere to one another. In addition, greater separation may be achieved, in part, by subjecting the bonded multicomponent fibers to the entangling process two or more times. It has been found that subjecting each side of the bonded substrate of multicomponent fibers to the entangling process significantly enhances the degree of separation. Thus, it is desirable that the bonded multicomponent fiber substrate be subjected to at least one run under the entangling apparatus wherein the water jets are directed to the first side and an additional run wherein the water jets are directed to the opposed side of the bonded substrate.

After the bonded multicomponent substrate has been entangled into an integrated nonwoven web, it can be dried by a through drier and/or drying cans and wound on a winder. Useful drying methods and apparatus may be found in, for example, U.S. Pat. Nos. 2,666,369 and 3,821,068.

Figure 7:
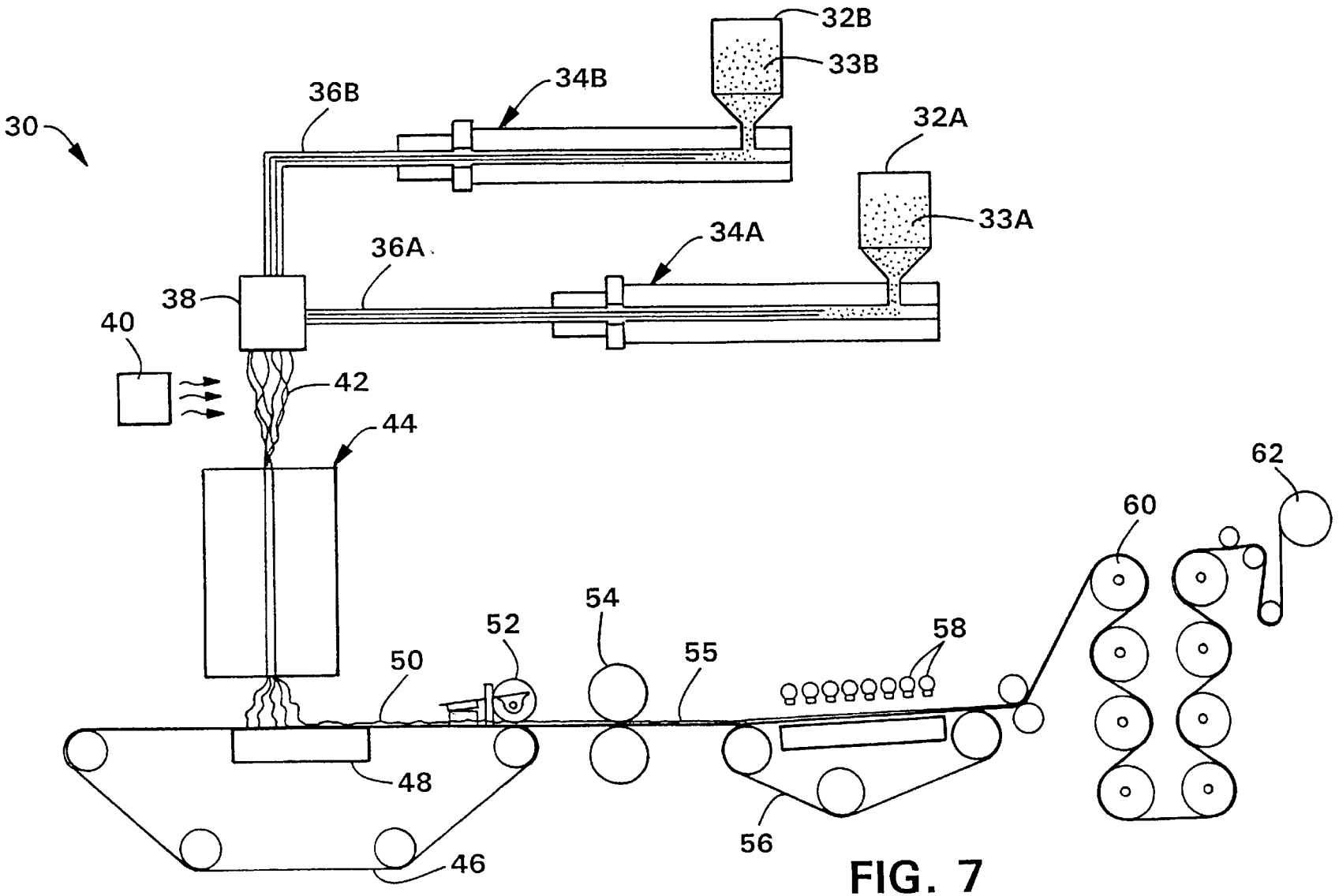
FIG. 7 is a schematic view of an exemplary process line for forming a nonwoven web of the present invention.

In reference to FIG. 7, a process line 30 for fabricating a nonwoven web of the present invention is disclosed. Hoppers 32A and 32B may be filled with the respective polymeric components 33A and 33B. The polymeric components are then melted and extruded by the respective extruders 34A and 34B through polymer conduits 36A and 36B and through spin pack 38. Spin packs are well known to those skilled in the art and, generally, include a housing containing a plurality of distribution plates stacked one on top of the another with a pattern of openings arranged to create flow paths for directing the polymeric components as desired. The fibers are then extruded through a spinneret upon leaving spin pack 38. As the extruded filaments extend below the spinneret, a stream of air from a quench blower 40 quenches the multicomponent filaments 42. The filaments 42 are drawn into a fiber draw unit or aspirator 44 and out of the outer opening onto a traveling forming surface 46, with the aid of vacuum 48, to form an unbonded layer or substrate of multicomponent fibers 50. The unbonded multicomponent fiber substrate 50 may be lightly compressed by compression rollers 52 and then bonded, such as thermal point bonding by bonding rollers 54, thereby creating a layer or substrate of bonded multicomponent fibers 55. Bonded substrate 55 may then be hydraulically entangled, while supported on an apertured support 56, with streams of liquid from jet devices 58. It will be appreciated that the process could be readily varied in order to treat each side of the bonded substrate web 55 in a continuous line. After the bonded substrate 55 has been hydraulically entangled, it may be dried by drying cans 60 and wound on a winder 62.

The process of the present invention, in one aspect, allows for the fabrication of a nonwoven web comprising an entangled web of continuous multicomponent thermoplastic fibers, wherein at least a portion of the individual components of the multicomponent fibers are separated therefrom. The entangled web may have bond areas therein comprising at least about 5% of the surface area of the web and wherein one or more continuous fibers within the bond areas are separated from said bond points. The nonwoven web desirably has bond areas comprising from about 5 to about 50% of the surface area of the web and, even more desirably, from about 10 to about 30% of the surface area of the web. In addition, the nonwoven web may have bond areas which are discrete areas spaced across substantially the entire surface area of the web. Due to the nature of the present process, the bond areas of the resulting fabrics are at least partially degraded. Partially degraded bond areas become discontinuous and may often have continuous fibers extending therethrough.

The entangle web has a cloth-like feel as well as improved barrier properties due to the entangling and fine fibers resulting from fiber separation Although bonded, the resulting fabrics have considerably increased softness relative to the pre-entangled bonded substrate. The fabrics may have a softness, as measured by the Cup Crush Test described herein below, at least about one third softer and desirably softer by about 50% or more. Moreover, increased softness may be obtained without a substantial loss in barrier properties or opacity. In addition, the desired softness and barrier properties are achieved while substantially maintaining the strength of the bonded substrate. It is also important to note that the present invention allows for the formation of a web of microfibers of two different types of polymers and the above characteristics without the need to fabricate a tricomponent fiber or the need for a slip-agent.

It will be appreciated that the fibers of the nonwoven web may contain conventional additives or be further treated to impart desired characteristics, e.g., wetting agents, antistatic agents, fillers, pigments, UV stabilizers, water-repellent agents and the like. It will likewise be appreciated that additional materials or components may be added to the nonwoven web to give the web improved or varied functionality, e.g., by adding pulp, charcoals, clays, super absorbents materials, starches and the like. In this regard see, for example, U.S. Pat. Nos. 5,284,703 and 5,389,202 issued to Everhart et al. regarding high pulp content hydroentangled nonwoven webs.

Due to the beneficial characteristics of the nonwoven materials of the present invention, the nonwoven materials have a wide variety of uses, including: washable reusable fabrics; reusable or disposable wipes, including special cleaning applications for lenses, glass or pre-metal printing surfaces; garments such as, for example, those described in commonly assigned U.S. Pat. No. 4,823,404 issued to Morrell et al.; personal care products; and infection control products, such as an SMS (spunbond-meltblown-spunbond) sterilization wrap as described in commonly assigned U.S. Pat. No. 4,041,203 issued to Brock et al., the entire contents of which are incorporated herein by reference. The fabric of the present invention may also be used in barrier fabrics; for example, the entangled web may be laminated to liquid impervious microporous films such as described in U.S. Pat. No. 4,777,073 issued to Sheth. Although the entangled fabric may be laminated to a microporous film by means such as thermal point bonding or ultrasonic bonding, use of an adhesive, desirably a patterned applied adhesive, would often be preferred in order to maintain the softness and other beneficial tactile properties of the entangled web.

TEST METHODS

Cup Crush: The softness of a nonwoven fabric may be measured according to the "cup crush" test. The cup crush test evaluates fabric stiffness by measuring the peak load (also called the "cup crush load" or just "cup crush") required for a 4.5 cm diameter hemispherically shaped foot to crush a 23 cm by 23 cm piece of fabric shaped into an approximately 6.5 cm diameter by 6.5 cm tall inverted cup while the cup shaped fabric is surrounded by an approximately 6.5 cm diameter cylinder to maintain a uniform deformation of the cup shaped fabric. An average of 10 readings is used. The foot and the cup are aligned to avoid contact between the cup walls and the foot which could affect the readings. The peak load is measured while the foot is descending at a rate of about 0.25 inches per second (380 mm per minute) and is measured in grams. The cup crush test also yields a value for the total energy required to crush a sample (the "cup crush energy") which is the energy from the start of the test to the peak load point, i.e. the area under the curve formed by the load in grams on one axis and the distance the foot travels in millimeters on the other. Cup crush energy is therefore reported in gm-mm. Lower cup crush values indicate a softer laminate. A suitable device for measuring cup crush is a model FTD-G-500 load cell (500 gram range) available from the Schaevitz Company, Pennsauken, N.J.

Grab Tensile Test: The grab tensile test is a measure of breaking strength and elongation or strain of a fabric when subjected to unidirectional stress. This test is known in the art and conforms to the specifications of Method 5100 of the Federal Test Methods Standard 191A. The results are expressed in pounds to break and percent stretch before breakage. Higher numbers indicate a stronger, more stretchable fabric. The term "load" means the maximum load or force, expressed in units of weight, required to break or rupture the specimen in a tensile test. The term "strain" or "total energy" means as the total energy under a load versus elongation curve as expressed in weight-length units. The term "elongation" means the increase in length of a specimen during a tensile test. Values for grab tensile strength and grab elongation are obtained using a specified width of fabric, usually 4 inches (102 mm), clamp width and a constant rate of extension. The sample is wider than the clamp to give results representative of effective strength of fibers in the clamped width combined with addition strength contributed by adjacent fibers in the fabric. The specimen is clamped in, for example, an Instron Model TM, available from the Instron Corporation, 2500 Washington St., Canton, Mass. 02021, or a Thwing-Albert Model INTELLECT II available from the Thwing-Albert Instrument Co., 10960 Dutton Road, Phila., Pa. 19154, which have 3 inch (76 mm) long parallel clamps.

Frazier Permeability (air permeability): A measure of the permeability of a fabric or web to air is the Frazier Permeability which is performed according to Federal Test Standard 191A, Method 5450 dated Jul. 20, 1978, and is reported as an average of 3 sample readings. Frazier Permeability measures the air flow rate through a web in cubic feet of air per square foot of web per minute or CFM.

EXAMPLE 1

Beads of Nylon-6 (clear Nyltech #2169) and polypropylene with 1% $TiO_2$ (Escorene® PD 3445 purchased from Exxon Chemical Company), were introduced into respective first and second hoppers of an extruder. The material was advanced through the extruder by rotation of the extrusion screw and was progressively heated to a molten state by a plurality of discrete steps in which, the temperature was gradually elevated as the material advanced through discrete heating zones having temperatures of 400/360, 480/380 and 500/400 respectively for the nylon-6 and polypropylene. The spin pack temperature was set at 500° C. and the spin pumps respectively at 500/400° C. The spin pack was configured to produce a multicomponent fiber comprised of 16 pie shaped segments, such as shown in FIG. 2. The multicomponent fibers were extruded from the capillaries of the spinneret, drawn from the spinneret by the draw unit with a draw pressure of 75 psi (pounds per square inch) and quenched. The multicomponent fibers were, with the aid of a vacuum, laid on a traveling foraminous surface traveling at 8.5 feet/min. and wound on a winder. The unbonded layer of spunbonded material had a basis weight of about 2.0 osy (about 68 gsm).

Figure 8A:
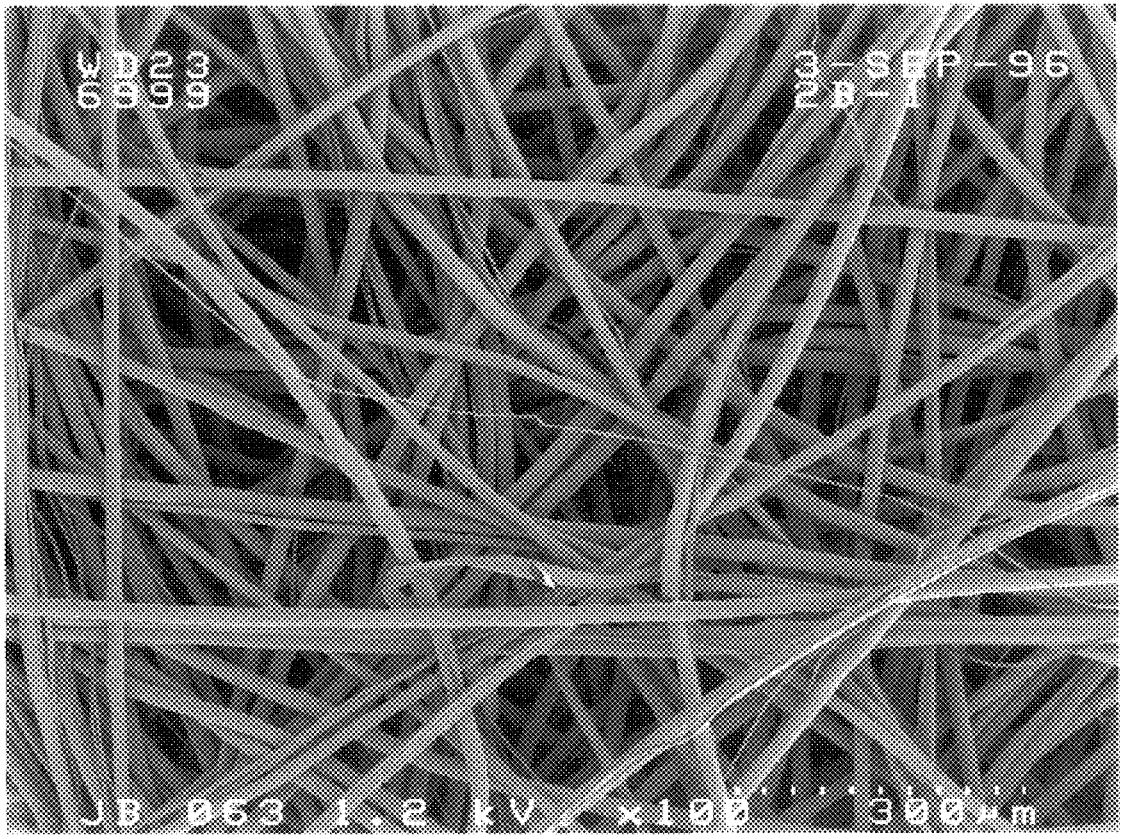
Figure 8B:
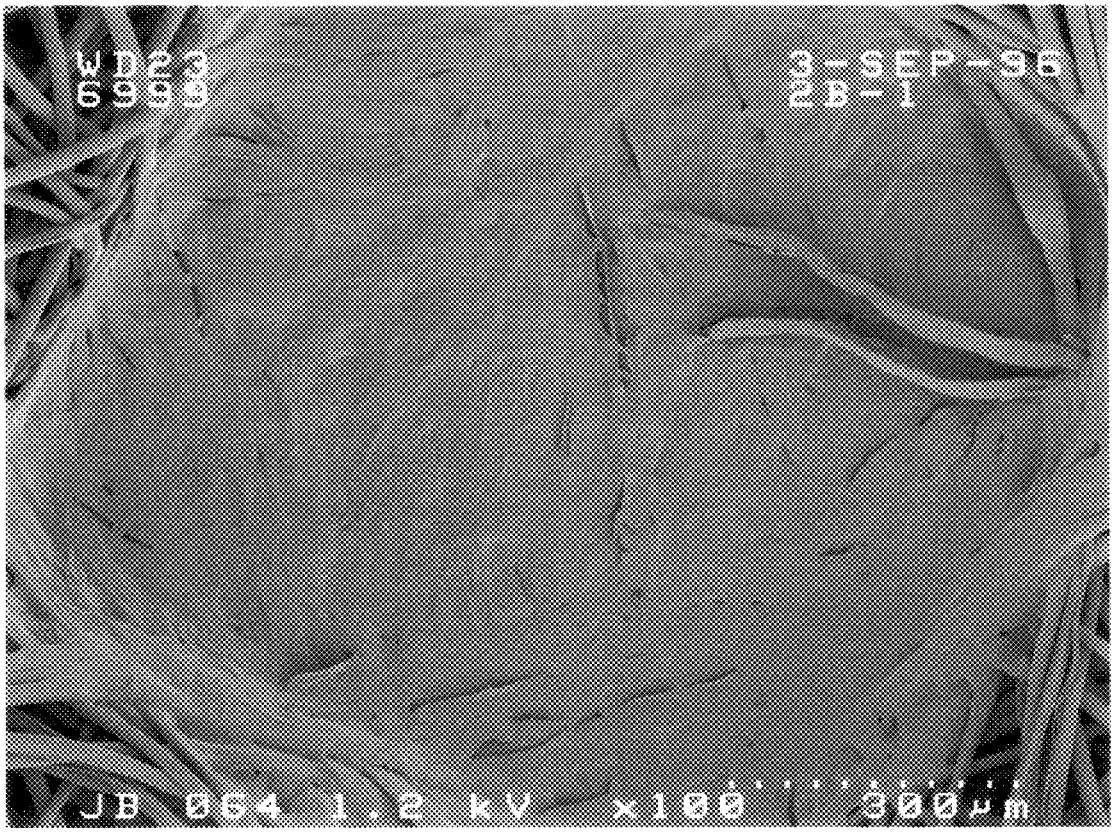
Figure 9A:
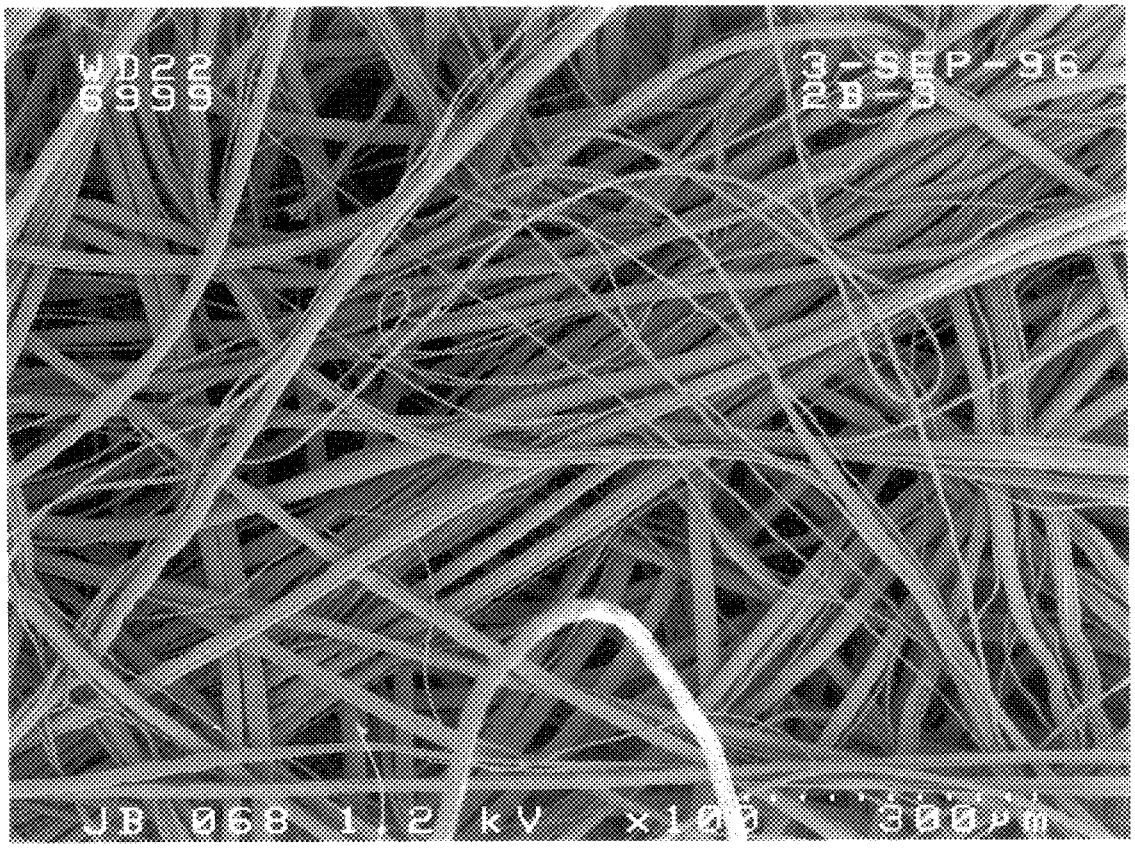
Figure 9B:
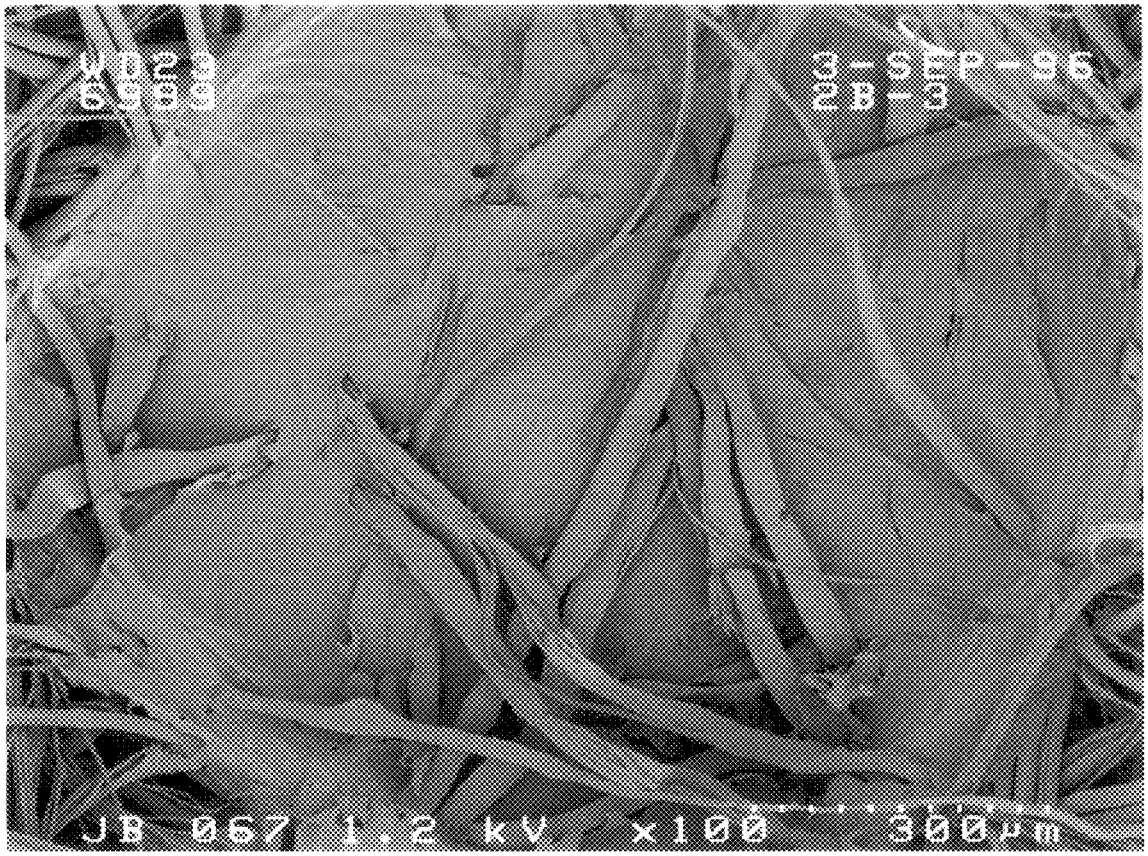
Figure 10A:
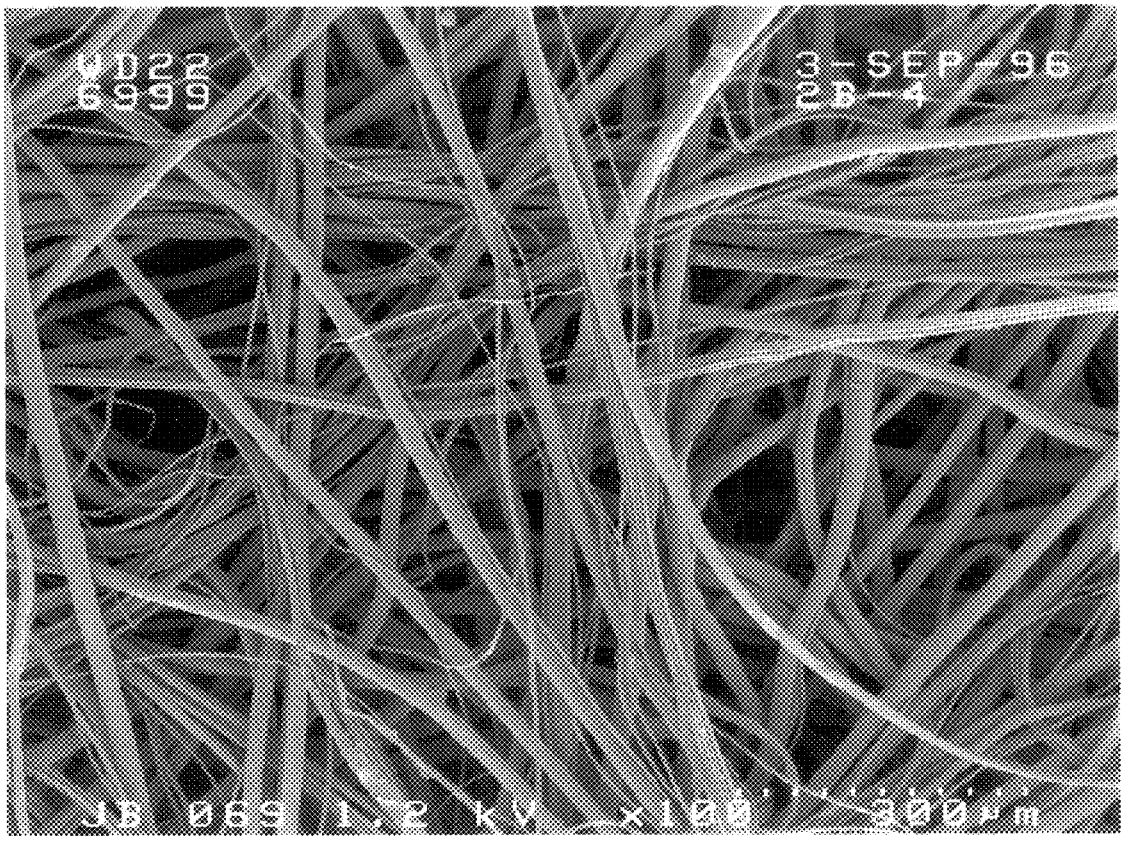
Figure 16B:
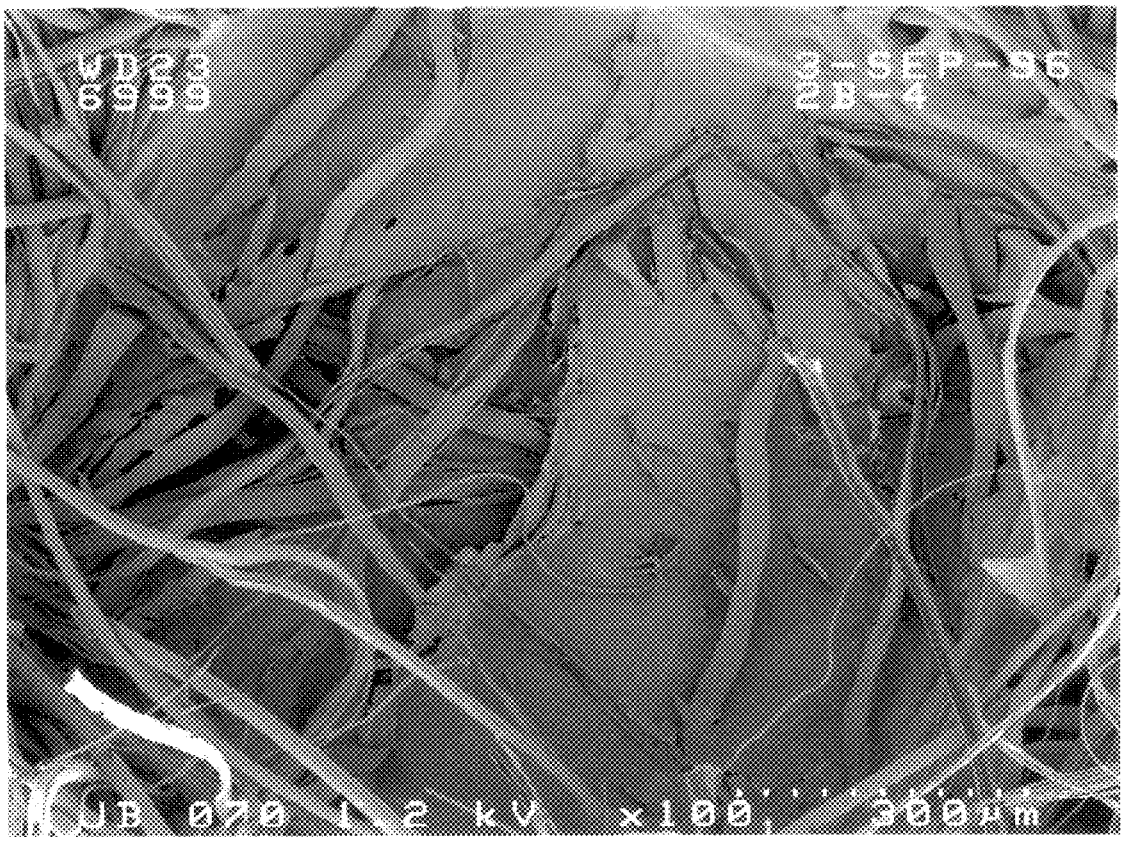
FIG. 16 is a graph of load versus energy impact product in a Cup Crush Test for nonwoven webs nylon-6/LLDPE, polypropylene/LLDPE and polypropylene/polypropylene bicomponent fibers bonded prior to entangling.
Figure 14:
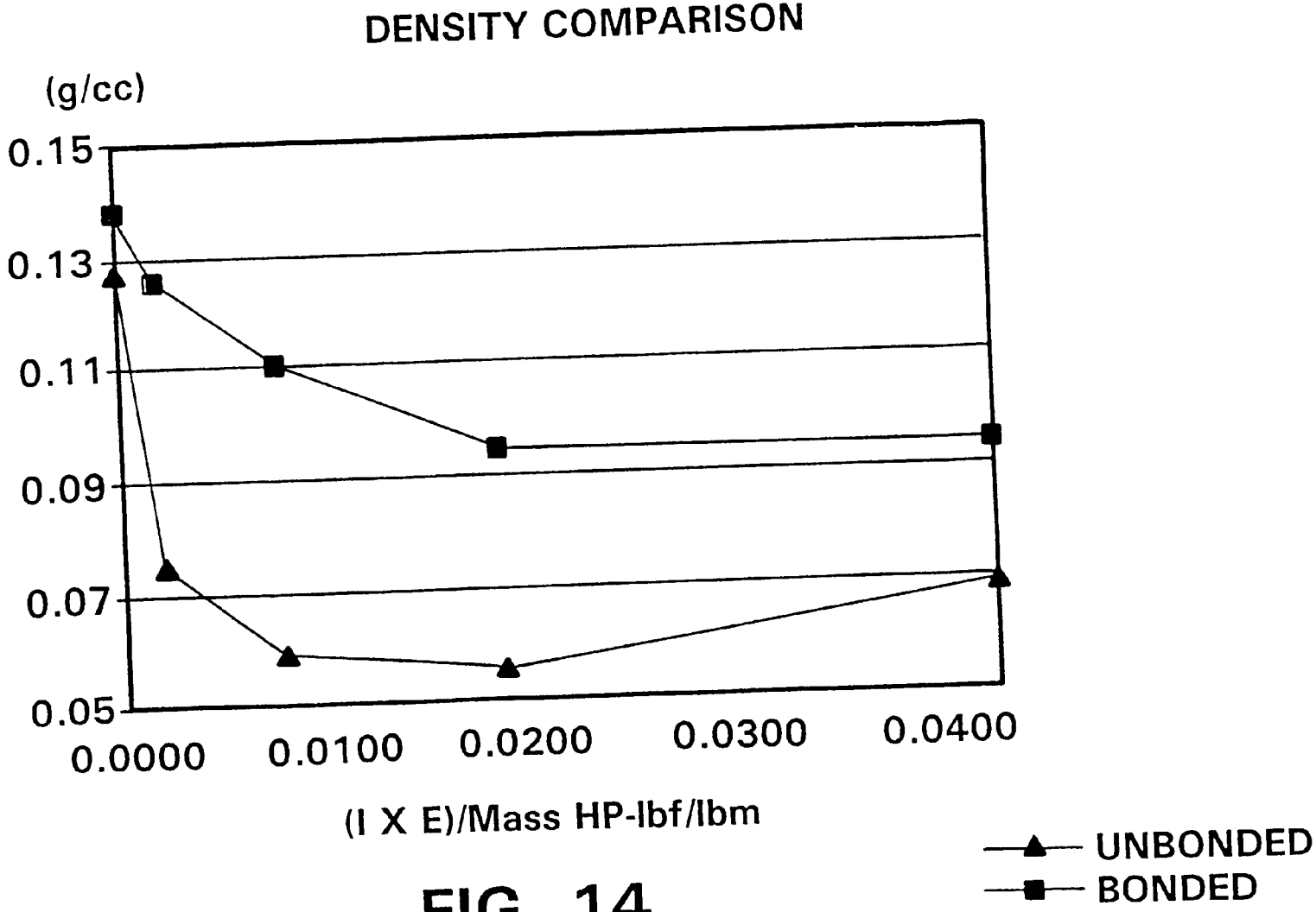
FIG. 14 is a graph of density versus energy impact product for hydroentangled webs which were bonded prior to entangling and hydroentangled webs unbonded prior to entangling.
Figure 15:
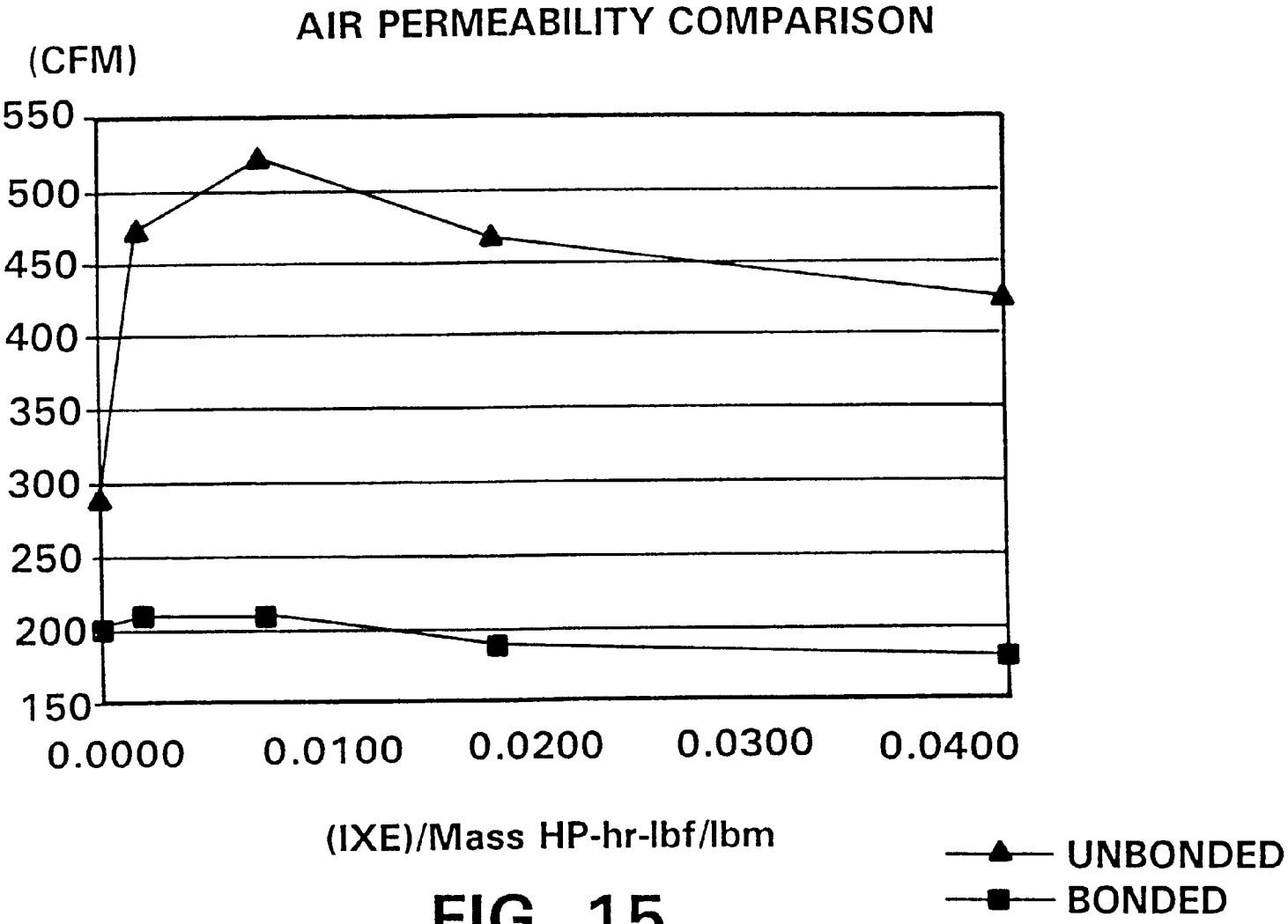
FIG. 15 is a graph of air permeability versus energy impact product for hydroentangled webs which were bonded prior to entangling and hydroentangled webs that were unbonded prior to entangling.

The unbonded substrate of multicomponent fibers was unwound and run at 25 feet/minute through a H&P roll and anvil which were both heated to 278° F. and set to provide a loading of 75 pli (pounds per linear inch). The unbonded substrate was thermally point bonded and wound on a winding roll. The bonded substrate was subsequently unwound and then hydroentangled with a hydroentangling apparatus having a single row of water jets with 40 holes per inch and 0.005 inch diameter holes. The fabric throughput was about 0.7 pih (pounds per inch width per hour) with a line speed of 10 feet/min. The water pressure was 400 psi resulting in an initial energy impact product of about 0.001. The bonded substrate was passed under the hydroentangling apparatus a second time, with the opposite side facing the jets, resulting in a total energy impact product of about 0.002. SEMs of the resulting fabrics are shown in FIGS. 8A and 8B. Identical bonded substrates were also separately hydroentangled, as above, with increased water pressures of 700, 1000 and 1400 psi resulting in total energy impact products of 0.007, 0.018 and 0.043, respectively. SEMs of the resulting fabrics entangled at 0.002, 0.007 and 0.043 are shown in FIGS. 8, 9 and 10, respectively. Air permeability and density of the resulting fabrics are shown in the graphs of FIGS. 14 and 15.

EXAMPLE 2

Figure 11:
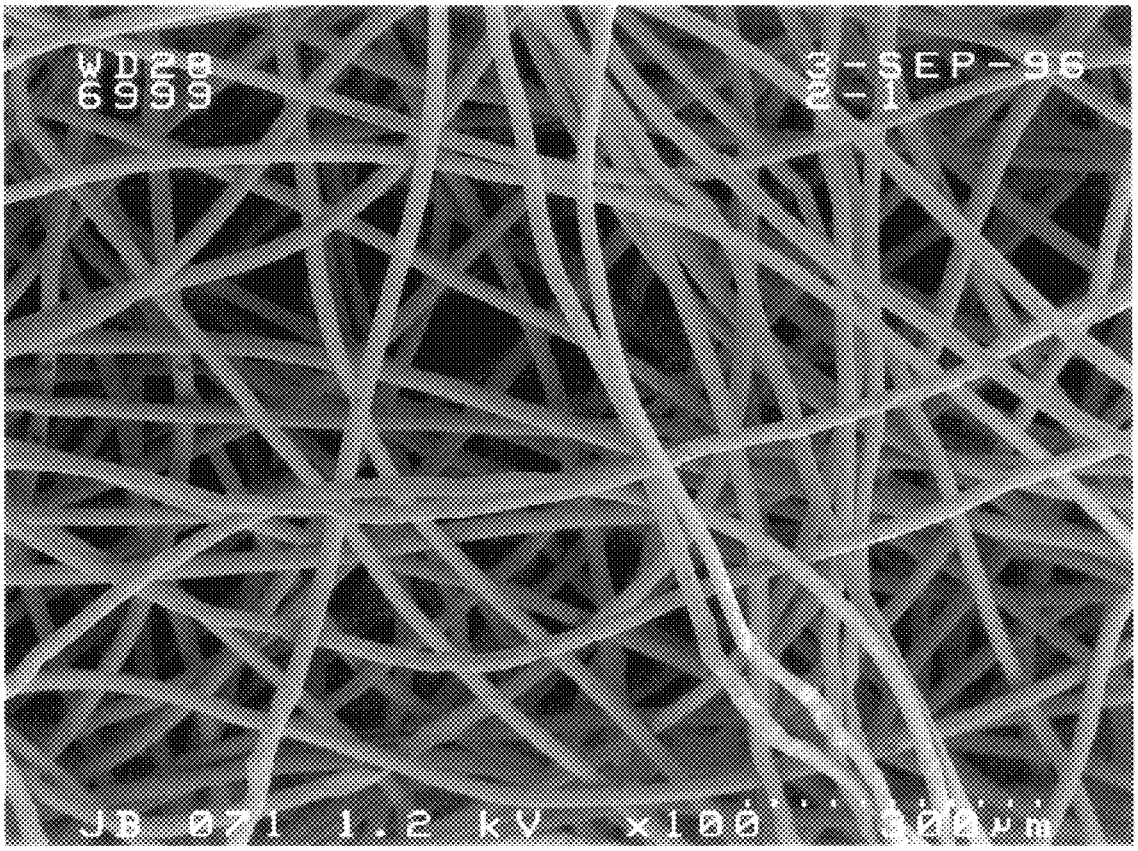
FIGS. 11–13 are comparative SEMs (100×magnification) of a representative portion of a nonwoven web which was not bonded prior to hydroentangling.
Figure 12:
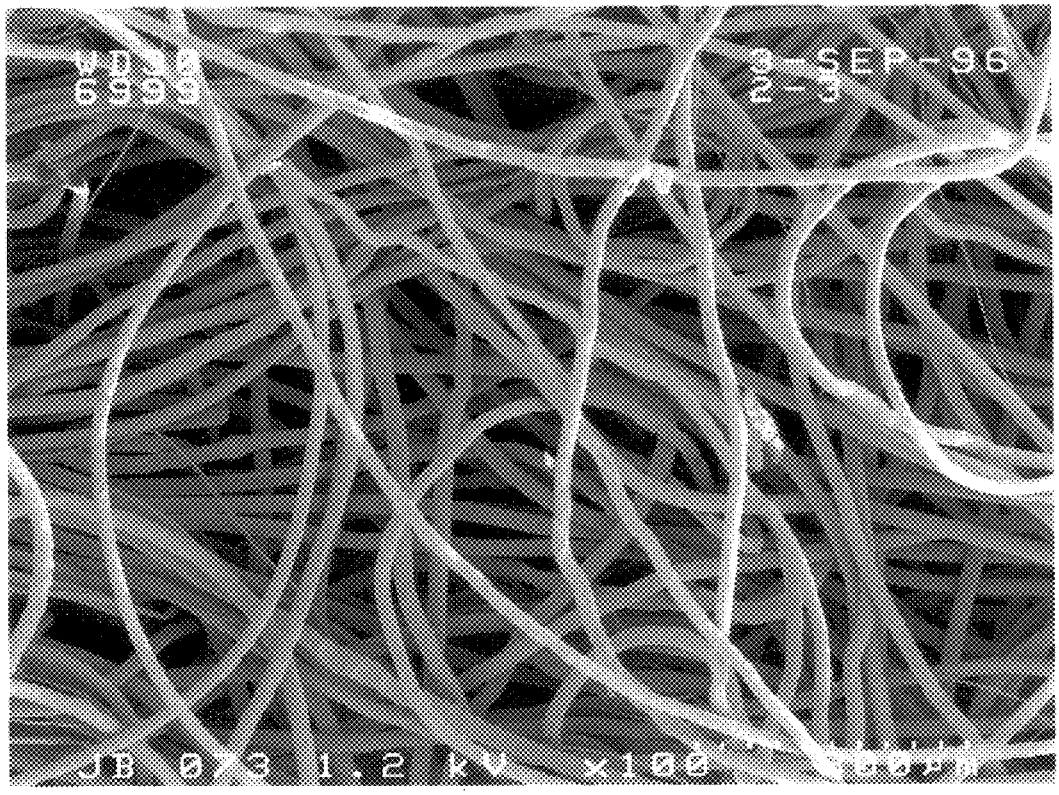
Figure 13:
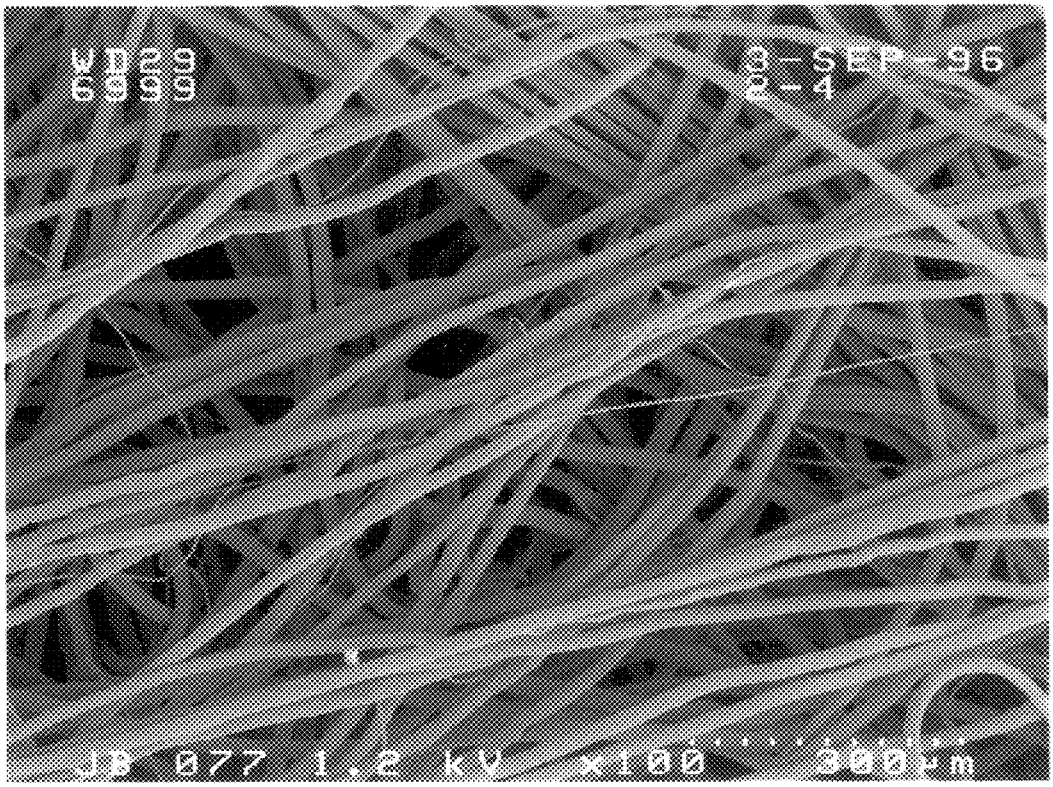

Multicomponent fibers comprised of alternating pie shaped segments of nylon-6 and polypropylene were fabricated in accord with the process described above in Example 1. The resulting unbonded substrate of multicomponent fibers was then, without previously bonding the multicomponent fibers, entangled at the same energy impact products in accord with the hydraulic entangling process described above in regard to Example 1. SEMs of the resulting fabrics entangled at energy impact products of 0.002, 0.007 and 0.043 are shown in FIGS. 11, 12 and 13, respectively. Air permeability and density of the resulting fabrics are shown in FIGS. 14 and 15. (The data corresponding to the fabrics of example 2 being designated as "unbonded").

Comparison of the photomicrographs of the webs formed by the process of example 1 and example 2 reveal distinct differences in the respective webs. Specifically, comparing FIG. 8A and FIG. 11, the photomicrographs show that even at lower impact energies, the bonded substrate experiences separation of the multicomponent fibers whereas the unbonded substrate experiences no separation. Further, comparing FIG. 9A with FIG. 12 and FIG. 10A with FIG. 13, as the energy impact products increase, so does the degree of fiber separation. However, greater separation is achieved by the bonded substrates with respect to the corresponding unbonded material. Moreover, it will be appreciated that comparable fiber separation is achieved at lower water pressures and lower energy impact products then achieved by similar unbonded substrates at higher pressures or impact energies.

In addition, in reference to FIGS. 8B–10B, it is shown that the bond areas of the bonded multicomponent substrates are partially degraded by the hydroentangling process. Further, it is shown that the extent of this degradation increases with the energy impact product. Multicomponent fibers, originally part of the bond area, become separated from the bonded portion. However, although having been partially or entirely separated from the bond area, the fibers remain in intact and extends beyond the bond area. Further, in reference to FIGS. 14 and 15, unlike the unbonded materials the bonded substrates retained an air permeability similar to that of the pre-entangled substrate as well as experience less decreases in density.

EXAMPLE 3

Figure 16:
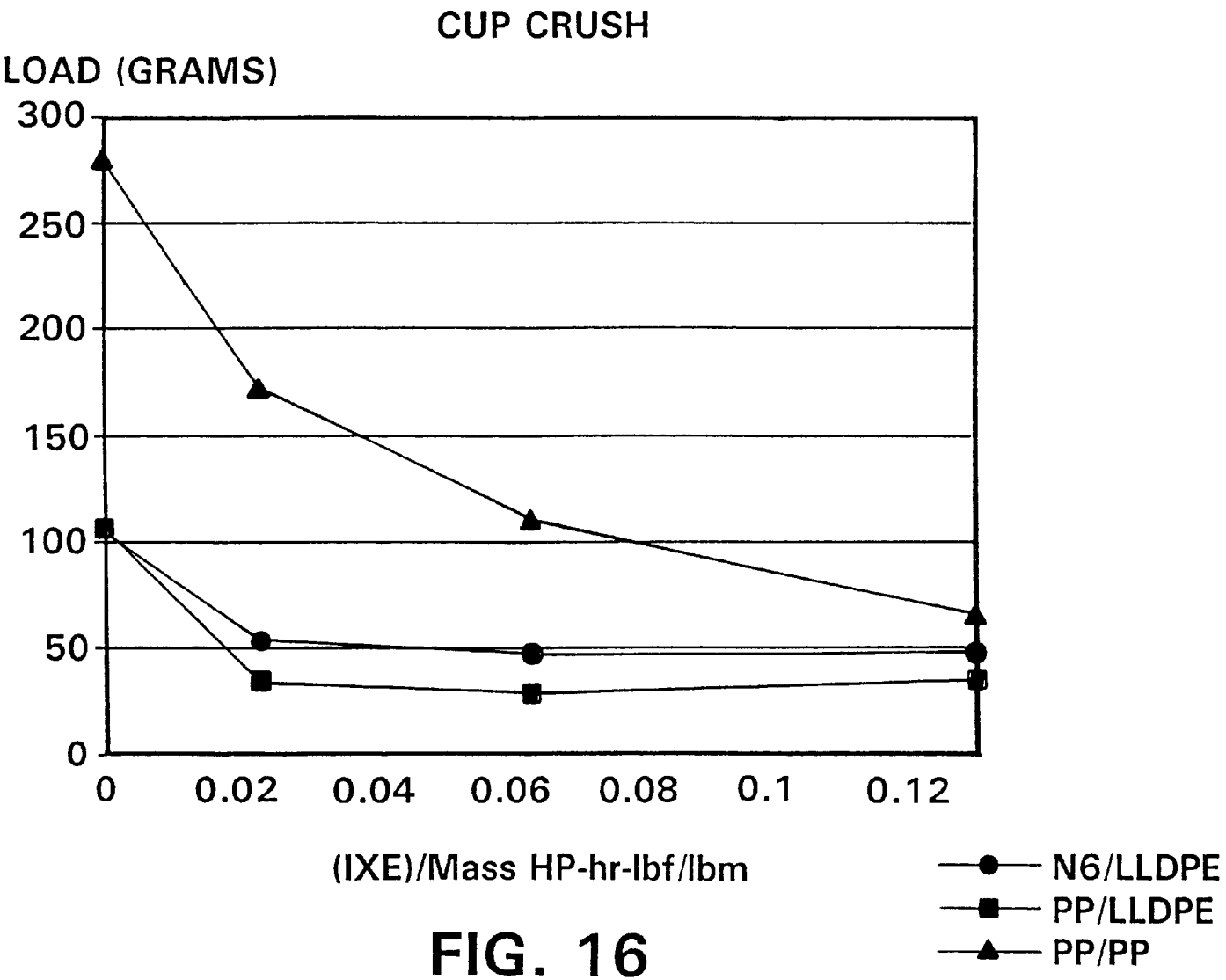
Figure 17A:
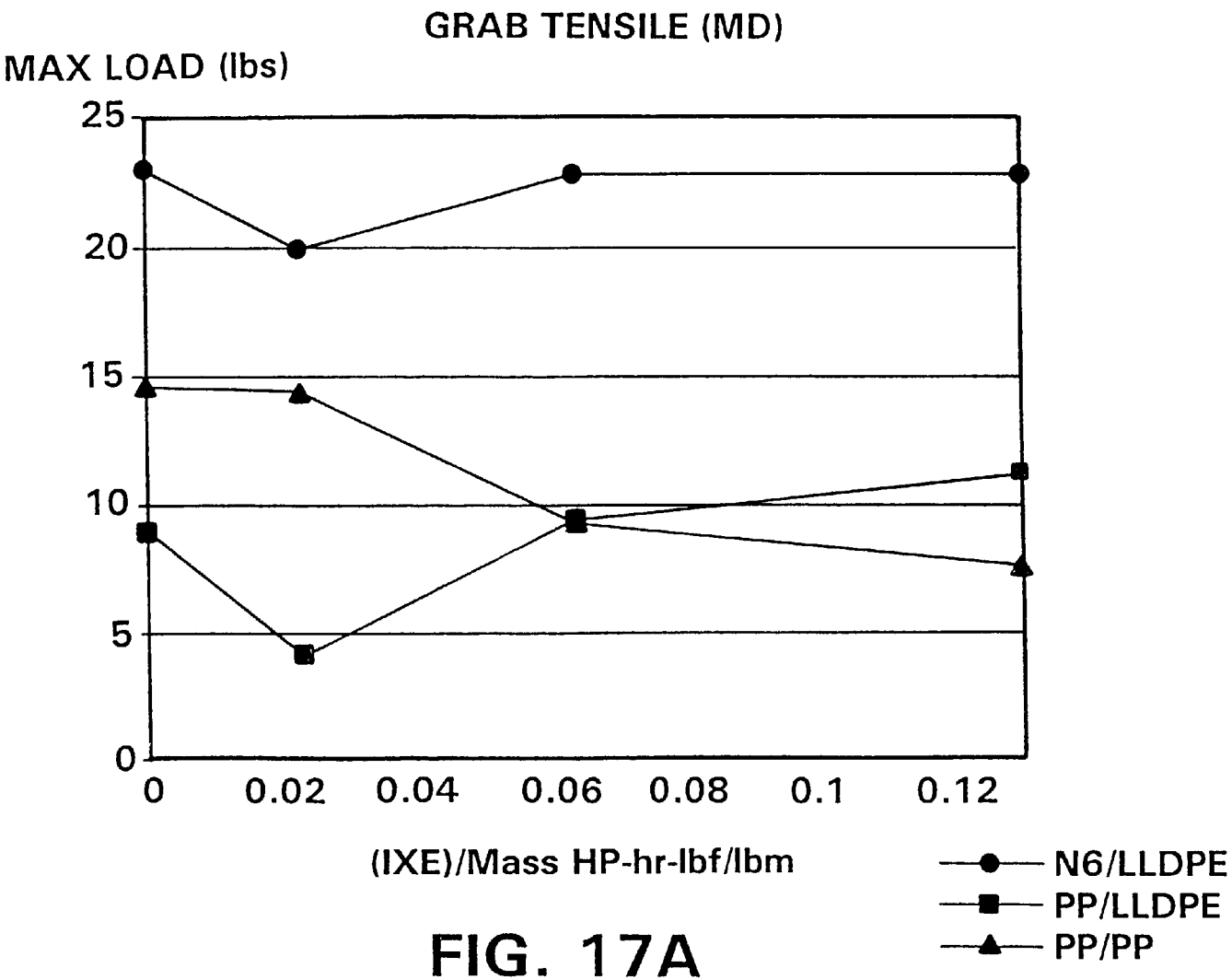
FIG. 17A and 17B are graphs of the machine-direction (MD) and cross-direction (CD) grab tensile strengths versus energy impact product of bicomponent fiber webs of nylon-6/LLDPE, polypropylene/LLDPE and polypropylene/polypropylene bonded prior to entangling.
Figure 17B:
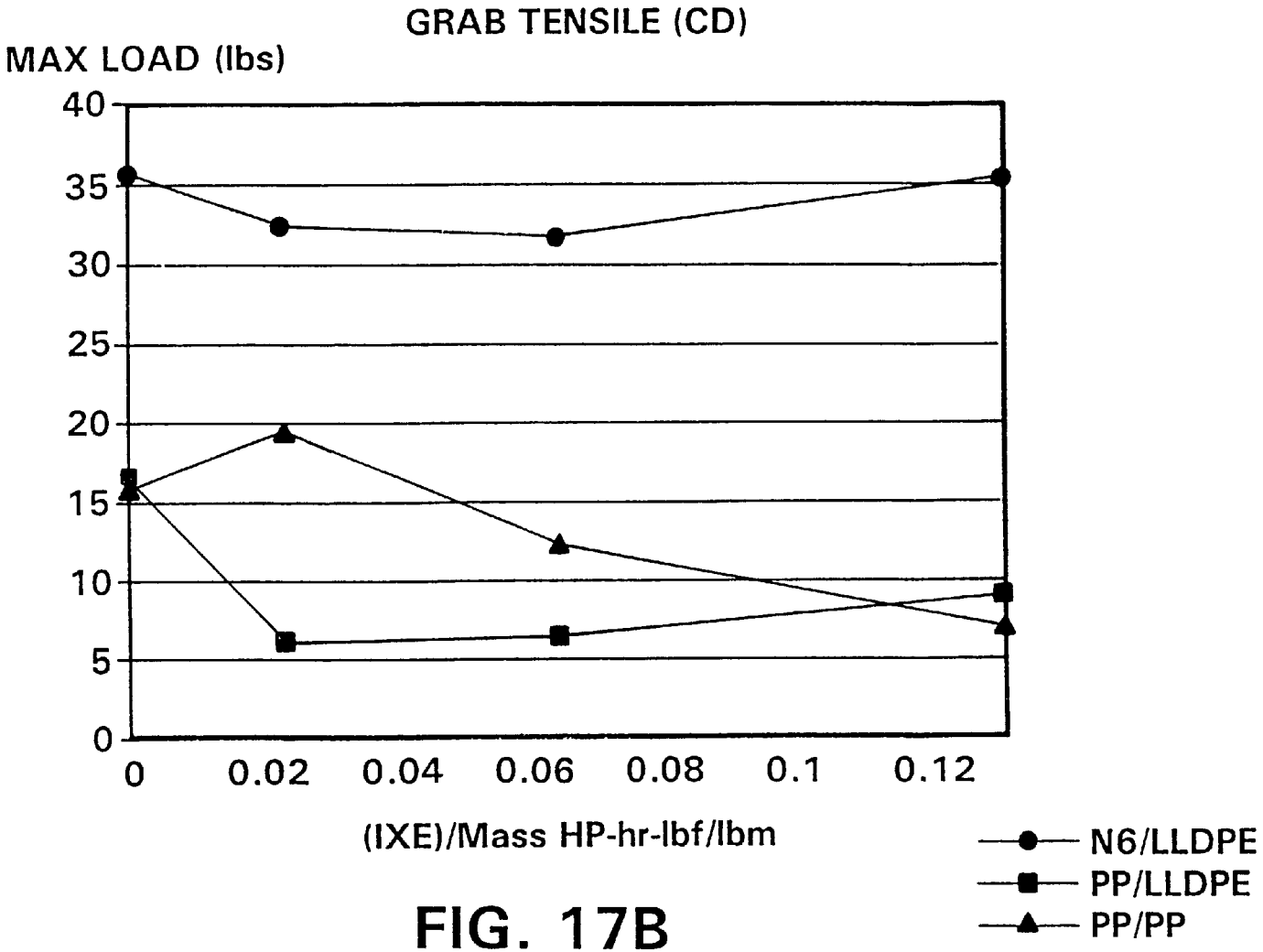

Sixteen pie shaped segmented fibers of alternating pie shaped segments, were fabricated of alternating segments of (i) nylon-6 and LLDPE; (ii) polypropylene and LLDPE; and (iii) polypropylene and polypropylene. No slip agents were added to the formulations. The conjugate fibers were laid on a moving foraminous surface into a layer and thermal point bonded with an H & P thermal point bond pattern. The resulting bonded layers had basis weights of about 1.5 osy, the related data was normalized with regard to variations in basis weights. The respective layers were then hydroentangled at various energy impact products. The softness, using the Cup Crush Test, of the entangled fabrics versus the energy impact product is shown in FIG. 16. In addition, the MD and CD tensile strength of the fabric were likewise analyzed versus the energy impact product, as shown in FIGS. 17A and 17B. The plots show that a fabric having a considerably softer quality may be achieved without an appreciable loss in strength. It should be noted that no surfactant was added to the conjugate fibers and little or no splitting was experienced with the polypropylene-polypropylene conjugate fibers.

While the invention has been described in detail with respect to specific embodiments thereof, it will be apparent to those skilled in the art that various alterations, modifications and other changes may be made to the invention without departing from the spirit and scope of the present invention. It is therefore intended that the claims cover all such modifications, alterations and other changes encompassed by the appended claims.

What is claimed is:

1. A nonwoven web comprising:

an entangled web comprising continuous spunbond multicomponent thermoplastic fibers and microfibers, said multicomponent fibers comprising a plurality of individual components having a portion exposed at an outer surface of the multicomponent fiber and said microfibers comprising individual components separated from said multicomponent fibers;

said entangled web having partially degraded bond areas therein comprising at least about 5% of the surface area of said web and wherein a portion of the continuous fibers within said bond areas are separated therefrom.

2. The nonwoven web of claim 1 wherein said bond areas comprise from about 5 to about 50% of the surface area of said web.

3. The nonwoven web of claim 2 wherein said bond areas comprise from about 10 to about 30% of the surface area of said web.

4. The nonwoven web of claim 3 wherein said bond areas are discrete areas spaced across substantially the entire surface area of said web.

5. The nonwoven web of claim 4 wherein said degraded bond areas are spaced in a defined pattern extending across substantially the entire web.

6. The nonwoven web of claim 1 wherein the components within said multicomponent fibers comprise polyethylene and polyester.

7. The nonwoven web of claim 1 wherein the components within said multicomponent fibers comprise polyethylene and nylon.

8. The nonwoven web of claim 1 wherein the components within said multicomponent fibers comprise polypropylene and nylon.

9. The nonwoven web of claim 1 wherein the components within said multicomponent fibers comprise polyethylene and polypropylene.

10. The nonwoven web of claim 1 wherein at least one of the components within said multicomponent fibers contains a surfactant.

11. The nonwoven web of claim 2 wherein said bond areas are formed by the methods selected from the group consisting of thermal and ultrasonic bonding.

12. The nonwoven web of claim 2 wherein said bond areas are formed by thermal point bonding.

13. The nonwoven web of claim 2 wherein said bond areas are formed by ultrasonic bonding.

* * * * *